United States Patent [19]

Demny et al.

[11] 4,086,800

[45] May 2, 1978

[54] PROCESS AND ROLLING MILL FOR STRETCH REDUCTION OF TUBES

[75] Inventors: Werner Demny, Dusseldorf-Oberkassel; Hermann Moltner, Dusseldorf, both of Germany

[73] Assignee: Friedrich Kocks GmbH & Co., Dusseldorf, Germany

[21] Appl. No.: 750,374

[22] Filed: Dec. 14, 1976

[30] Foreign Application Priority Data

Dec. 20, 1975 Germany ..... 2557707

[51] Int. Cl.[2] ..... B21B 17/00

[52] U.S. Cl. ..... 72/205; 72/234; 72/367

[58] Field of Search ..... 72/205, 208, 367, 234

[56] References Cited

U.S. PATENT DOCUMENTS

| | | | |
|---|---|---|---|
| 3,645,121 | 2/1972 | Pfeiffer | 72/205 |
| 3,919,872 | 11/1975 | Demny et al. | 72/205 |
| 4,002,048 | 1/1977 | Pozgay | 72/205 |

*Primary Examiner*—Milton S. Mehr

*Attorney, Agent, or Firm*—Buell, Blenko & Ziesenheim

[57] ABSTRACT

A process and mill for stretch reduction rolling of tubes is provided having individually driven roll stands, said roll strands being driven so as to impart a maximum traction force, limited only by the transferability of frictional forces between roll and tube, on the tube in all the passes that grip said tube, at least in the passes at the entry end of the mill.

4 Claims, 8 Drawing Figures

PROCESS AND ROLLING MILL FOR STRETCH REDUCTION OF TUBES

This invention relates to a process and rolling mill for stretch reduction of tubes and particularly to improvements on the process and rolling mill of our U.S. Pat. No. 3,919,872, issued Nov. 18, 1975.

It is well known that substantial longitudinal sections that have a greater wall thickness than the middle longitudinal section are formed at the front and back ends of a rolled tube during its stretching reduction. Both end sections of each tube thus exceed the admissible wall thickness tolerance, must be cut off, and can be used only as scrap. These "thickened ends" of the said longitudinal sections arise as a result of the process. They form as a result of the fact that in order to achieve a definite decrease in the wall thickness of the finished tube a certain traction must be exerted on the tube, and during rolling this traction is indeed exerted to a sufficient degree on the middle section, but not in the thickened ends of the tube. This is due to the fact that the great traction required cannot be achieved, e.g., between the first two pass openings of the rolling mill because the rolls of a pass permit the development of only limited frictional forces that are not sufficient to achieve the maximum traction. The maximum traction in the middle region of the already introduced longitudinal tube section does not develop until several, e.g., six pass openings have equipped the entering tube and is maintained only until the tube end section passes out of the rolling mill and the number of pass openings that are still rolling is too small to effect the maximum traction. Because the front and rear end sections of each tube are always gripped during the rolling process by a smaller number of pass openings than is required to achieve the maximum traction, they are never subjected to it, such that the thickened ends necessarily develop.

The problem of keeping the thickened ends as short as possible, and consequently the proportion of scrapped material to a minimum, during the stretch-reduction rolling in order to achieve economical rolling thus arises.

Because, as initially stated, the thickened ends are the result of the lesser tensile stress on the front and rear tube sections, attempts have already been made to solve the problem by increasing the tensile stress on these sections. Thus, German Letters Pat. No. 1,602,181 proposes a continuous increase in the r.p.m. of the following stands when the front end of the tube enters the first stand and a continuous decrease in the r.p.m. of the first stand after the tube end section has entered it. However, it is still unclear as to how the continuous r.p.m. increase and/or decrease is to take place and, in particular, how great it should be. An arbitrary increase in the r.p.m.'s induces little or no shortening of the thickened ends. For example, if the roll r.p.m. of the second stand is increased by a definite amount and the r.p.m. of the third roll stand by an equal amount, no greater traction develops in the tube between the second and third roll stands than is present in conventional stretch-reduction rolling mills due to the normal r.p.m. series. The result is thickened ends of normal length. If, in another example, the roll r.p.m. of the second stand is increased by a large amount and the roll r.p.m. of the third stand by a lesser amount, a decrease in the traction that is present at the normal r.p.m. of a conventional stretch-reduction rolling mill may even occur between the second and third stands. This may even result in a prolongation of the thickened ends. The upshot of this is that just any increase in the roll r.p.m.'s does not offer a complete solution to the problem, but rather the decisive factor here is the type of r.p.m. increase and/or decrease.

In addition, the familiar process of the prior art requires that only the stands following the first stand, i.e., the second stand and so on, should undergo an increase and/or decrease in the r.p.m. Consequently, the first stand maintains its original r.p.m. We have found that, contrary to present practices, this is not correct when the tube end section enters the first stand, because the first stand must then be regulated down, since an optimally short thickened end can never be achieved inasmuch as the traction developing between the first and second stands is only slight or completely nonexistent.

German Offenlegungsschrift No. 1,962,792 also proposes imposing an increased traction on the thickened ends and keeping them as short as possible in this manner, but does not offer precise data as to the amount involved. Thus, the said previous publications provide no specific r.p.m. settings for the rolling mills and the problem is not resolved with the data presented.

The German Offenlegungsschriften Nos. 1,752,713 corresponding to U.S. Pat. No. 3,645,121 and 1,927,879, and well as 1,927,880 show a process in which the thickened end sections are to be subjected to greater tensile stress, in contrast to the conventional processes; this is to be achieved through an r.p.m. decrease, which is then cancelled after the initial and end sections of the tube have passed through. The r.p.m. changes proposed here are uniformly distributed over the stands and amount to 5% from stand to stand, such that the r.p.m.'s always increase or decrease in steps by the same amount. By so doing, a certain shortening of the thickened ends is indeed achieved as compared with conventional stretch-reduction rolling mills, but is has been discovered that such an r.p.m. regulation in individually driven stands was not capable of reducing the thickened ends to the length that have already been achieved with familiar stretch-reduction rolling mills with series drive (the journal *Iron and Steel Engineer* of April, 1974, page 70).

Nevertheless, the length of the thickened ends can be substantially reduced in accordance with out earlier Pat. No. 3,919,872, both in stretch-reduction rolling mills with series drive and in those with individual drive. This is achieved by imposing a maximum tensile force, which is limited only by the transferability of the frictional forces between roll and tube, on the tube, at least in the next to the last traction-producing pass opening in the region of the traction-producing front pass opening in the rolling direction of the mill as the beginning of the tube is feeding in and as the tube end is running in or out of this region. This knowledge and the means by which this and thus the further shortening of the thickened ends are attainable are demonstrated by our earlier patent through specification of the so-called c-value necessary for this. This c-value is explained in the following:

The force exerted by a roll on the tube in the direction of rolling, i.e., a tensile action, is essentially a function of the frictional forces in the region of the contact surfaces between roll and tube. These frictional forces are influenced by the ratio of the periperal roll speed to the tube passage speed. This ratio is different at the individual circumferential sites of the tube because the roll radius is also different at the individual circumferential sites of the tube touched by a roll, while the roll r.p.m. remains the same. Thus, it may be that the peripheral speeds of the roll are greater or lesser than the tube passage speed at all the circumferential sites of the tube that are contacted by a considered roll. However, it is also possible that the peripheral speeds of a roll are greater than the tube passage speed at individual circumferential sites of the tube and smaller at other circumferential sites of the tube. In the latter case there are sites on the tube periphery at which the peripheral speed of the roll and the tube passage speed are identical. The distance of these sites from the axis of rotation of the roll is designated as the roll radius. The peripheral speed calculated from the roll radius and the roll r.p.m. is thus identical to the tube passage speed.

Depending on the ratio of the initial roll speed to the tube passage speed at the individual circumferential sites of the tube, the components of the frictional forces at the surface elements can be arranged in the same way, both in and counter to the direction of rolling. On the other hand, they can be partly arranged oppositely and also be in or counter to the direction of rolling. It is quite evident that in the case of frictional forces arranged in the same way at the individual surface elements, the resultant assumes a maximum value. The direction of the frictional forces is determined by the relative speed between roll and tube at the considered site. The result is that if the peripheral speed of the roll is greater than the tube passage speed at each point of the contact surface between roll and tube, the roll exerts a maximum tensile force on the tube. The latter is the case if the roll radius is identical to or smaller than the roll radius in the region of the pass bottom, i.e., in the region of the roll working surface site that works the deepest into the roll body. If the appropriate diameters are selected instead of the radii, the following formula is obtained:

$$R = \tfrac{1}{2} \cdot (WD - D). \qquad \text{I}$$

In this formula R stands for the roll radius, D for the external diameter of the tube, and WD for the ideal roll diameter, which is equal to twice the distance between the axis of rotation of the roll and the longitudinal axis of the tube. More generally, formula I). can be written in the following form:

$$R = \tfrac{1}{2} \cdot (WD - C \cdot D) \qquad \text{II}$$

where $c$ is a factor determining the roll radius. It has a value of 1 if the roll radius is equal to the roll radius in the region of the pass bottom. If the peripheral speed of the roll is greater than the tube passage speed at all the circumferential sites of the tube that are touched by a considered roll, the c-value is also greater than 1. On the other hand, if the peripheral speed of the roll is less than the tube passage speed at each of these circumferential sites, the c-value becomes less than 1 and assumes a maximum value of 0.5 for a three-roll pass. If the c-value is 0.5 or less, the roll draws with maximum force on the tube counter to the direction of rolling, while with a c-value or 1 or more it draws the tube with maximum force in the direction of rolling.

If the traction is maintained constant or only slightly changed in a considered pass, the c-value is approximately 0.9 in a three-roll pass, depending on the ratio of roll and tube diameter and on the diameter decrease. The precise value is obtained from the force equilibrium in the tube under the roll. If, for example, the tube has entered all the 24 stands of a rolling mill, the traction is developed in the first, e.g., 4 to 6 passes. This means that the first 4 to 6 passes draw on the tube counter to the direction of rolling. When the maximum possible traction forces are utilized, the c-values of the first pass of the three-roll mill should be approximately 0.5 or less. The last of the rolling passes, e.g., passes 20–24, reduce the tractions; this means that the rolls draw on the tube in the direction of rolling and their c-values should be 1.0 or more. Beyond the tractions-increasing passes 1–6 are the passes 7–19 that maintain the traction constant or change it only slightly and which have c-values between 0.8 up to more than 0.9, in which case the c-values decrease slightly with increasing number of passes due to the fact that the rolls become larger.

It is evident from the above that a jump in the c-values from approximately 0.5 to approximately 0.9 takes place beyond the traction-increasing first 6 passes for example. This means that the r.p.m.'s are also speeded up, i.e., a greater transformation ratio develops between two adjacent passes in the transition region from traction-increasing to traction-stabilizing passes. The transformation ratios are calculated from the continuity equation $$F \cdot V = F_1 \cdot V_1 \qquad \text{III}$$

in which the cross section areas of the tube are designated by F and $F_1$ and the tube passage speeds by V and $V_1$ in two adjacent passes. If the formula for the peripheral speed $$V = \pi \cdot n/30 \cdot R \qquad \text{IV}$$

is inserted into formula III.), we obtain $$F \cdot n \cdot R = F_1 \cdot n_1 \cdot R_1 \cdot \qquad \text{V}$$

The latter formula can be transposed to $$n/n_1 = F_1/F \cdot R_1/R = i \qquad \text{VI}$$

which denotes the transformation ratio $i$.

If formula II.) is inserted into formula VI.), we obtain $$i = \frac{F_K \cdot (WD_K - c_K D_K)}{F_{K+1} \cdot (WD_{K+1} - c_{K+1} \cdot D_{K+1})} \qquad \text{VII.)}$$

where the pass number is denoted by K. It is evident from formula VII.) that when the c-values vary by jumps, the transformations also vary by jumps because the values for F and D essentially vary uniformly.

The transformation ratios of conventional rolling mills are calculated, in contrast to our earlier patent, by the above method, i.e., assuming a so-called stationary state, that is, the tube is present in all the passes of the rolling mill and the initial and end sections are beyond or in front of the rolling mill. These ratios are however no longer in agreement if both end sections of the tube are passing through the rolling mill. For example, if the beginning of the tube passes through the rolling mill, the passes that roll the front longitudinal sections of the tube should always be traction-reducing passes, the c-values of which are at least 1 or more, if the maximum possible trction is to be applied. Because the considered beginning end of the tube exhibits less stretching for the above reasons than the middle section of the tube, a site in the region of the tube beginning passes a particular point in the rolling mill at a lower speed than a site in the region of the tube middle section. In contrast to the previously indicated roll r.p.m., a particular cross section of the beginning of the tube thus passes more slowly through the pass than a particular section of the central portion. Consequently, the rolls draw more on the beginning of the tube and the c-value is automatically established at 1.0 or higher with no variation in r.p.m. However, this is valid only from the, e.g., 6th pass on, because only then is the difference in the lesser stretching of the beginning tube section sufficiently large as compared with the middle tube section at a particular site of the rolling mill. This occurs at the 6th pass because the maximum traction has not developed until then. Additional prerequisites for the automatic establishment of the c-value at 1 or more are naturally that the dimensions and the profiling of the passes and the r.p.m. series are flawlessly tuned with each other, and that the r.p.m.'s are maintained constant independently of whether and to what extent a tube has entered the rolling mill. The latter is completely achieved in the familiar rolling mills with the so-called series drive, in which two r.p.m. series are superimposed with fixed transformations.

The situation is similar at the rear end section of the tube also, which likewise undergoes a lesser stretching than the middle tube section, such that it follows the latter more rapidly in running out of the rolling mill. The tube end section thus has a greater velocity at a considered site in the rolling mill than a section of the middle longitudinal tube section. The greater velocity of the tube end section has the consequence that the c-value is 0.5 or less in a rolling mill with three-roll passes, without variation in the roll r.p.m.'s, such that the rolls exert their maximum traction counter to the direction of rolling. This is also true in familiar rolling mills only with the identical prerequisites as in the beginning of the tube, and the effect occurs only when the tube end section has passed through the 6th pass, for example.

Thus, if the transformations and r.p.m.'s have been determined for the stationary state, the initial and end sections of the tube are rolled in the middle and rear sections of the roling mill after a certain number of passes under the above conditions, such that maximum traction effects can be applied there by the rolls.

These maximal traction effects, which automatically develop beyond the, e.g., 6th pass under the said conditions, are not present to the fullest extent or at all in the region of the 1st to the 6th passes in conventional rolling processes and rolling mills. This is due to the fact that the difference in stretching between the beginning of the tube and tube middle section is still too small in the initial passes.

After the c-value and the most important relationships have been elucidated, we shall consider the present problem. In order to maintain the thickened tube ends as short as possible, an attempt is made to impose a maximum possible traction on the tube in the region of the forward, e.g., the 1st to 6th passes also. However, this can be achieved only incompletely or not at all with conventional processes and rolling mills because in them the roll r.p.m.'s have always been chosen in accordance with the stationary state, in which case the c-value is selected at 0.5 in the first pass in the three-roll mill; it then increases to approximately 1.0 in the 2nd to 6th passes for example. These c-values and the resulting r.p.m.'s are not suitable for the first pass in order to shorten the thickened ends appreciably, especially so because with c-values that are between 0.5 and approximately 1.0 in the three-roll mill the components of the frictional forces are not arranged in the same way at all the surface elements, but are oppositely oriented with these c-values. It can thus be readily seen that in this case the resultant of the frictional forces does not assume a maximum value and consequently the rolls of this pass cannot roll with the maximum possible traction force on the tube. Consequently, no appreciable and no optimal shortening of the thickened ends can be achieved with the conventional rolling mills. Depending on the tube dimensions and the dimensions and other data of the rolling mill, they are approximately 2.2 – 2.5 meters long.

The process elucidated in the German Offenlegungsschriften Nos. 1,752,713, 1,927,879 and 1,927,880 establishes the roll r.p.m.'s of the front passes of the rolling mill at different values as the beginning of the tube passes into rolling mills with individually driven stands in order to increase the traction in the region of these front passes. In contrast to the two proposals mentioned initially in the first and second places, which proposed only quite generally and indeterminately an increase in the tensile stress on the tube, without specifying the means of achieving this or the practical values, these three proposals reveal a stepwise r.p.m. variation by 5%. However, because the normal r.p.m. series of the rolling mill is set up in the conventional manner in these proposals, which means that the c-value of the first three-roll pass is approximately 0.5 and the c-values of the subsequent passes increase up to 1.0, c-values below approximately 0.5 or above ca. 1.0 are not achieved either with a stepwise r.p.m. variation by the identical amount of 5%. Consequently, the rolling mills set up in accordance with this familiar process can never exert the maximum possible traction in the region of their front passes, even though a slight improvement over the original rolling mills is achieved, namely a shortening of the thickened ends, e.g., from 2.2 – 2.5 meters to 1.9 – 2.1 meters. This slight improvement in individually driven roll stands does have a consequence that, as already stated, is still somewhat poorer than has been achieved in familiar stretch-reduction rolling mills with series drive and without any r.p.m. variation.

Our earlier U.S. Pat. No. 3,919,872, is the first to propose the imposition of a maximum traction force, limited only by the transferability of the frictional forces between roll and tube, on the tube in the region of the traction-increasing, front (with respect to direction of rolling) passes of the rolling mill when the beginning of the tube enters and the tube end leaves this region. In a rolling mill with three-roll stands this means the use of maximum c-values of approximately 0.5 in the traction-increasing front passes of the rolling mill, in which case c-values of 0.035 or less are used in the first roll stand. The result is that the peripheral speeds of all the rolls of the traction-increasing front stands are less than the tube passage speed at all the circumferential sites of the tube, such that only identically oriented frictional forces develop at the individual surface elements and the resulting frictional force assumes a maximum value. A maximum traction force, limited only by the transferability of the frictional forces between roll and tube, is then imposed on the tube. Due to the extremely low c-value in the first roll stand, which may even be close to zero, and the normally large c-value of approximately 1.0 – 1.1 of the last traction-increasing or first traction-maintaining pass, a substantial gradation of the c-values of the traction-increasing passes is possible, and the resulting r.p.m. jumps from one pass to the next are so great in the principal patent that the complete traction that the rolls are capable of transfering is imposed during the entrance of the beginning of the tube and the emergence of the tube end, such that the length of the thickened ends is optimally shortened.

The particularly large c-value and r.p.m. jump at the site of the rolling mill at which the complete traction is first achieved in the stationary state, i.e., between the second-to-the-last or the last traction-increasing and the first traction-maintaining pass, are characteristic for the solution according to the principal patent. This r.p.m. jump results from the fact that an attempt is made to keep the c-value of the traction-increasing front three-roll passes at approximately 0.5 or less, such that the resulting frictional force assumes a maximum value. Beyond the traction-increasing front passes, however, there are the traction-maintaining passes with c-values of approximately 1.0, such that the passage from the traction-increasing to the traction-maintaining passes takes place by a jump. In the case of rolling mills with series drive this r.p.m. jump is limited to one or two stand sites.

The purpose of the present invention is to maintain the thickened ends as short as possible also during the stretch-reduction of tube in a rolling mill with individually driven stands, after this has been achieved with the means of the principal patent in stretch-reduction rolling mills with series drive. The means of the principal patent can of course also be used in stretch-reduction rolling mills with individually driven roll stands, but the inventive concept of the principal patent can be further supplemented in the case of such rolling mills.

The present invention is thus based on a process for the rolling of tube with a stretch-reduction rolling mill, in which a maximum traction force, limited only by the transferability of frictional forces between roll and tube, is imposed on the tube, at least in the next to the last traction-increasing pass in the non-stationary state, at least in the region of the traction-increasing (in the stationary state), front (in the direction of rolling) passes of the rolling mill as the beginning of the tube enters and as the tube end leaves this region, as demonstrated by our earlier patent.

In contrast, the present invention is characterized by the fact that a maximum traction force, limited only by the transferability of frictional forces between roll and tube, is imposed on the tube in all the passes that grip it, at least in the front (with respect to the direction of rolling), e.g., six to eight passes as the beginning of the tube enters and the tube end leaves these passes, especially during stretch-reduction rolling with individually driven roll stands. By so doing, all possibilities are exhausted in imposing traction on the front and rear end sections of the rolled tube, such that the so-called thickened ends that develop due to the lack of tensile stress there are maintained optimally short.

An additional object of the invention is a rolling mill with individually driven roll passes for carrying out the above process, in which the r.p.m.'s of the rolls are variable during the rolling process as a function of the longitudinal tube section present in the rolling mill and which is characterized in accordance with the invention by the fact that the jump in the c-values and the roll r.p.m.'s that separates the traction-increasing and the traction-decreasing roll passes during entrance of the beginning of the tube always lies approximately in the middle of the stand series that are already gripping the tube, at least in the front half of the rolling mill. It is also advantageous if the jump in the c-values and roll r.p.m.'s that separates the traction-increasing and traction-decreasing roll passes during the emergence of the tube end, at least from the region of the front half of the rolling mill, always leads the tube end from stand to stand by the number of traction-increasing roll passes.

The result is that the r.p.m. jump in the rolling mill is shifted, such that it follows the entering beginning of the tube or the emerging tube end. Thus, a maximum tensile effect is advantageously exerted on the two end sections. In addition, the stretch-reduction rolling mill with individually driven roll stands and accompanying r.p.m. jump in accordance with the invention offers the possibility of beginning this accompaniment in different stands, which is of primary importance if it is necessary due to the available tube raw material and the desired dimensions of the finished tube for all the stand sites of the rolling mill to be occupied with roll stands. For example, if the available tube raw materials already have dimensions that are normally reduced only in the first three stands to the already present measurement in the case of a definite pass series, these first three stands are not required. It is thus possible in the rolling mill according to the invention, after omission of the first three roll stands, to regulate the fourth roll stand with respect to the c-values and the r.p.m. jump as would otherwise be done with the first roll stand. The drive of the rolling mill is then regulated such that the r.p.m. jump does not take place until between the fourth and fifth stands and accompanies the tube only from there on.

Although the present invention is of primary importance for rolling mills with individually driven roll stands, series drives are also conceivable, which at least partially facilitate an accompaniment of the r.p.m. jump, such that the present invention can also be used in rolling mills with series drive.

The invention is elucidated by the FIGURES.

The number of stands is plotted on the abscissae in all the FIGURES, in which case stand 1 is the first stand of the mill, viewed in the direction of rolling. The roll r.p.m.'s are plotted on the ordinates, in which case the specific numerical values were omitted because they are quite different and are not of interest in the present relationship. A tube end section is depicted under the abscissae, the front end section in FIGS. 1–4 and the rear end section in FIGS. 5–8. The indicated position of the end section clearly reveals how far the tube has entered the rolling mill if the curve shown is valid.

Figure 1:
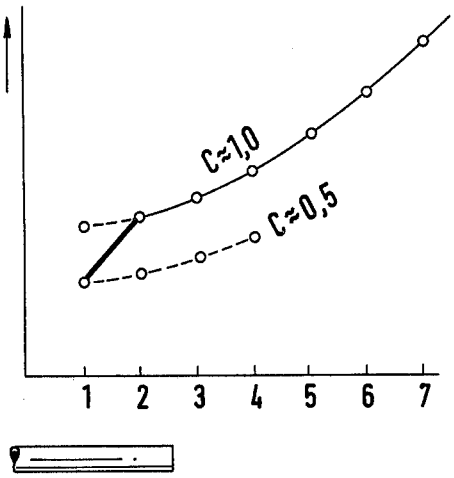
FIG. 1 is a graph showing roll r.p.m.'s versus number of roll stands and illustrating the change in r.p.m.'s between the first and second entering roll stands to produce tension in the tube as the tube enters the mill along with the position of the tube in the several stands.

Two parallel curves are shown in FIG. 1; both rise with increasing number of stands. The rise results from the increase in roll r.p.m. from stand to stand, with which allowance is made for the stretching of the tube, which occurs due to the normal rolling process. The upper curve gives the r.p.m.'s for a c-value of approximately 1.0 and the lower curve gives the r.p.m.'s for a c-value of approximately 0.5. When the beginning of the tube enters the second stand, the r.p.m. of the first stand is reduced such that a c-value of 0.5 results, while the r.p.m. of the second stand corresponds to a c-value of 1.0. There is thus a substantial r.p.m. jump between the first and second stands, such that the tube has a tensile force imposed upon it between the first and second stands which cannot be exceeded at this site of the rolling mill because the rolls of both roll stands draw on the tube in opposite directions with the maximum possible force. This occurs in spite of the fact that the rolls are rotating in the identical direction. Due to the guite different r.p.m.'s, the tube from the rolls of the first stand is passed into the rolling mill only relatively slowly, while the second roll stand, operating with a considerably higher r.p.m., draws against the braking action of the first stand with the maximum possible force on the tube.

Figure 2:
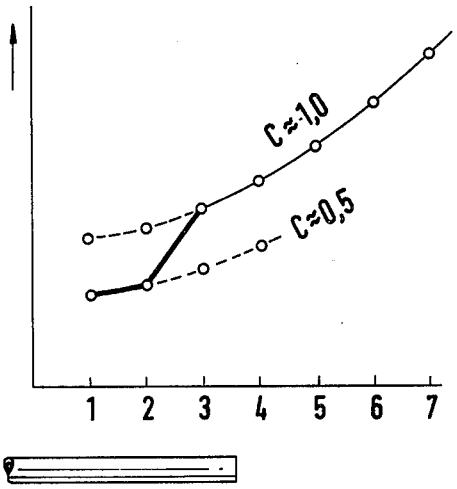
FIG. 2 is a graph as in FIG. 1 showing the change in r.p.m.'s between the first two entering roll stands and subsequent stands as the tube enters stand three.
Figure 3:
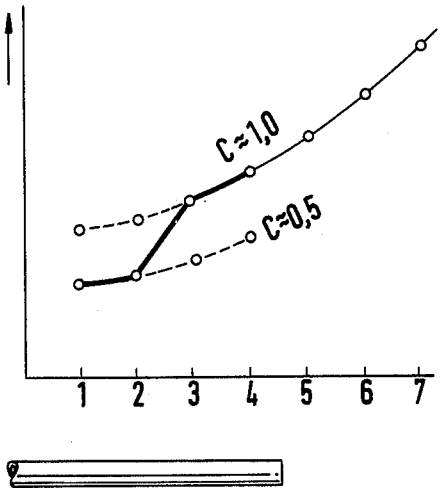
FIG. 3 is a graph as in FIG. 1 showing the change in r.p.m.'s between the first three entering roll stands and subsequent stands as the tube enters stand four.
Figure 4:
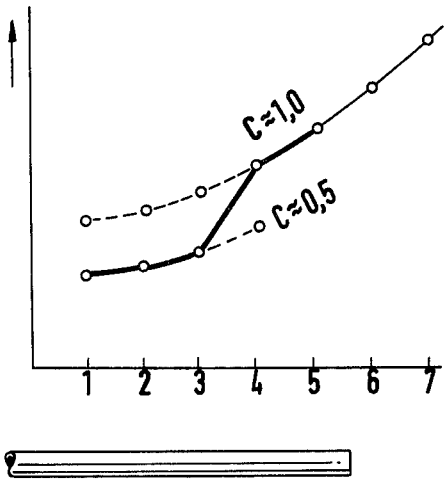
FIG. 4 is a graph as in FIG. 1 showing the change in r.p.m.'s between the first four entering stands and subsequent stands as the tube enters stand five.

It is evident from an examination of FIGS. 2–4 that with the subsequent progress of the beginning of the tube in the following stands the r.p.m. jump accompanies the tube into the rolling mill through the reduction of the r.p.m.'s of stands 2 and later 3. It continues in this manner until the maximum required traction on the tube is achieved, which occurs after the fourth to the sixth stands, depending on the extent of the traction. For there on an r.p.m. variation with the beginning of the tube passing through is no longer absolutely necessary, because due to the lesser stretching of the beginning of the tube, as initially explained, the r.p.m.'s established of the high stretching of the middle tube section have a sufficient excess so that a c-value of 1.0 or more is always present, which means the maximum possible traction and for the last stands the maximum possible traction reduction.

The r.p.m. variation always takes place only on one stand, such that there is a passage from a higher r.p.m. corresponding to a c-value of approximately 1.0 to a lower one, e.g., corresponding to a c-value of 0.5. This variation must take place as rapidly as possible so that the tube section passing through during the variation remains as small as possible due to the thickened end. The other r.p.m.'s always remain the same, such that only the r.p.m. jump is propagated. If the entrance stops, which is the case when the maximum required traction is achieved after, e.g., 6 stands, a slight r.p.m. correction may be expedient in the stands following the traction-increasing stands that maintain the traction approximately constant; this results from the equilibrium conditions.

Figure 5:
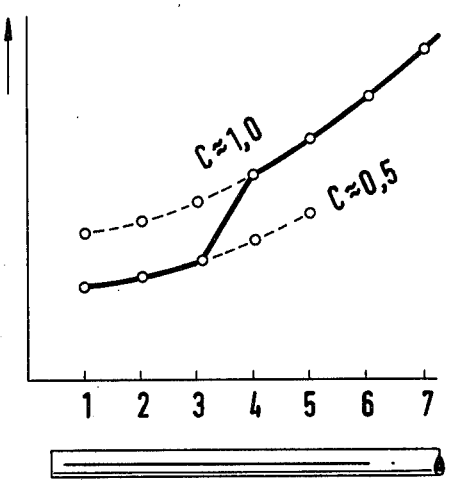
FIG. 5 is a graph showing roll r.p.m.'s versus number of roll stands and illustrating the change in r.p.m.'s between the first three and the fourth entering stands as the trailing end of the tube enters the mill.
Figure 6:
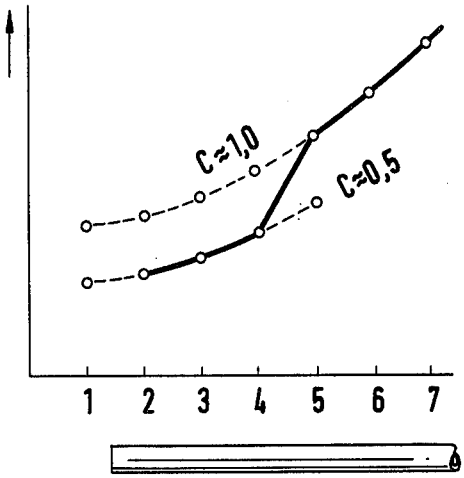
FIG. 6 is a graph as in FIG. 5 showing the change in r.p.m.'s between the first four entering roll stands and the subsequent roll stands as the tube trailing end pass the first stand.
Figure 7:
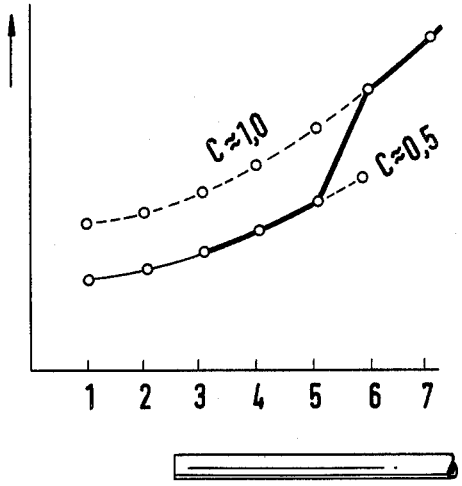
FIG. 7 is a graph as in FIG. 5 showing the change in r.p.m.'s between the first five roll stands and subsequent stands as the tubing leaves entering roll stand three.
Figure 8:
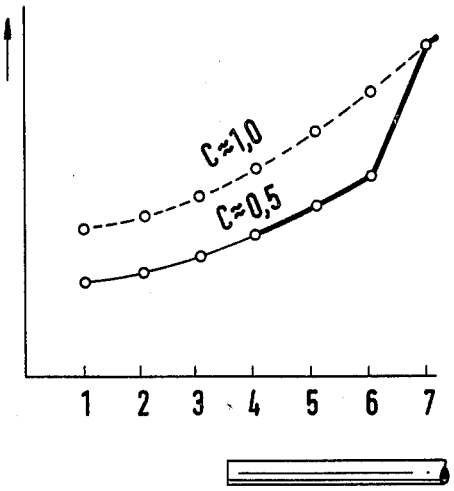
FIG. 8 is a graph as in FIG. 5 showing the change in r.p.m.'s between the first six roll stands and subsequent stands as the tubing leaves roll stand four.

FIGS. 5–8 show the situation for the passage of the tube end. For example, if three stands are required for the most rapid traction increase possible and the tube end leaves the first stand, the r.p.m. must be immediately reduced in the fourth stand to a value that corresponds for example to a c-value of 0.5, which is illustrated in FIGS. 5 and 6. The same is true for the fifth stand when the tube leaves the second stand. This continues on in this manner. Thus, an r.p.m. jump, which distinguishes the traction-increasing stands from the others, also accompanies the tube end here. The number of stands participating in the traction increase is dependent, among other factors, again on the selection of the diameter decreases in the pass series. The r.p.m. jump does not need to pass through the entire rolling mill because after a certain number of stands, e.g., after six to eight stands, the r.p.m.'s imposed on the stretching of the middle tube section during the passage of the tube end with the lesser stretching result in sufficiently large r.p.m. differences from stand to stand.

It is essential in all cases that the regulation takes place very rapidly and that the other r.p.m.'s are maintained stable. The passage of the r.p.m. jump through the entire rolling mill is basically possible.

In the foregoing specification we have set out certain preferred practices and embodiments of our invention, however, it will be understood that this invention may be otherwise practiced within the scope of the following claims.

We claim:

1. In a process for rolling tube with a stretch-reduction rolling mill having a plurality of successive roll stands, said stands each constituting a roll pass, the improvement comprising:

applying maximum traction or axial forces on a tube at the ends thereof to reduce the thickness thereof, said maximum traction forces being determined by the equation $R = \frac{1}{2}(WD-CD)$, where R represents the roll radius, D the external diameter of a tube, WD the ideal roll diameter and C a value indicative of roll peripheral speed, said maximum traction force determined from said equation being applied to a front end of said tube in each successive roll pass of several front stands, reducing said traction force in each said successive roll pass of said several front stands after said front end of said tube has entered a next succeeding stand of said several front stands, said traction force remaining constant in each said successive stand in which the traction force has been reduced whereby tension is exerted on the front end of said tube in said several front stands, reducing said traction force in all roll passes succeeding said front stand, before a rear end of said tube leaves a stand succeeding a next preceeding stand until the next to last stand of said rolling mill, said traction force remaining constant in each said successive roll pass whereby tension is exerted on the rear end of said tube in said stands until it leaves said rolling mill, said reductions in traction force being manifested by a decrease in C value, which decrease in C value is indicative of a reduction in peripheral speeds.

2. In a process as claimed in claim 1, wherein said several front stands wherein maximum traction force is exerted comprises the first six to eight passes.

3. In a process as claimed in claim 1 wherein the maximum traction force is applied by individually driving each roll stand to provide a roll speed differential between the roll pass just receiving the front end of said tube and the next preceeding pass so that a jump in c-value occurs successively between each roll pass as the front end of the tube passes through the several front stands, maintaining said jump in c-value intermediate the ends of said rolling mill at the last of said front stands until the rear end of the tube enters the rolling mill and then individually driving each roll stand following said front stands to provide a roll speed differential between at least the roll pass receiving the rear end of the tube and the next succeeding roll pass so that a jump in c-value occurs successively between each roll pass as the rear end of said tube passes through the stands following the several front stands and exits from the mill.

4. In a rolling mill having a plurality of roll stands with rolls, each roll stand forming a roll pass, said passes being divided into several traction increasing passes at the entry of the mill and several traction decreasing passes at the discharge end of the mill, for stretch-rolling tube in which a maximum traction force, limited only by the transferability of frictional forces between roll and tube, is imposed on the tube as the tube front end is entering and the tube rear end is leaving the rolling mill, the improvement comprising means for varying the r.p.m.'s of the rolls of each stand during the rolling process as a function of the longitudinal tube section present in the rolling mill, whereby a jump in c-values (said c-values being determined from the formula $R = \frac{1}{2}$ (WD-CD), where R represents the roll radius, D the external diameter of the tube and WD the ideal roll diameter) and a jump in roll r.p.m.'s occurs between each successive pass of the traction-increasing front passes and the next succeeding roll passes as the front end of the tube enters each next succeeding pass of said several traction-increasing passes, means for maintaining said jump in c-values and roll r.p.m.'s at approximately the middle of the stands of said rolling mill until the rear end of said tube enters said mill and means for varying the r.p.m.'s of the rolls of the traction-decreasing passes whereby a jump in c-values and r.p.m.'s occurs between each successive pass of the traction-decreasing roll passes until the rear end leaves the mill.

* * * * *

UNITED STATES PATENT OFFICE

CERTIFICATE OF CORRECTION

Patent No. 4,086,800 Dated May 2, 1978

Inventor(s) Werner Demny and Hermann Moltner

It is certified that error appears in the above-identified patent and that said Letters Patent are hereby corrected as shown below:

Column 1, line 30, "equipped" should be --gripped--.

Column 2, line 45, "out" should be --our--.

Column 3, line 38, "I" should be --I.)--;

line 45, "I)." should be --I.)--;

line 47, "II" should be --II.)--.

Column 4, line 26, "III" should be --III.)--;

line 33, "IV" should be --IV.)--;

line 37, "V"should be --V.)--;

line 41, "VI" should be --VI.)--;

line 67, "trction" should be --traction--.

UNITED STATES PATENT OFFICE
CERTIFICATE OF CORRECTION

Patent No. 4,086,800 Dated May 2, 1978

Inventor(s) Werner Demny and Hermann Moltner

It is certified that error appears in the above-identified patent and that said Letters Patent are hereby corrected as shown below:

Column 5, line 46, "roling" should be --rolling--.

Column 6, line 35, "ca." should be --approximately--.

Column 8, line 20, insert --not-- before "necessary".

Column 9, line 33, "guite" should be --quite--;

line 47, "For" should be --From--;

line 51, "of" should be --on--.

Signed and Sealed this

*Fifth* Day of *September 1978*

[SEAL]

*Attest:*

RUTH C. MASON
*Attesting Officer*

DONALD W. BANNER
*Commissioner of Patents and Trademarks*